US006597288B2

(12) United States Patent
Amano et al.

(10) Patent No.: US 6,597,288 B2
(45) Date of Patent: Jul. 22, 2003

(54) FIRE ALARM SYSTEM

(75) Inventors: Masayuki Amano, Hirakata (JP); Takayuki Nishikawa, Osaka (JP); Takeshi Wada, Tsu (JP); Shoichi Oka, Matsuzaka (JP); Junichi Watanabe, Daito (JP)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 10/000,025

(22) Filed: Dec. 4, 2001

(65) Prior Publication Data

US 2002/0186128 A1 Dec. 12, 2002

(30) Foreign Application Priority Data

Apr. 24, 2001 (JP) ..... 2001-126772

(51) Int. Cl.[7] ..... G08B 17/10

(52) U.S. Cl. ..... 340/628; 340/522; 340/577; 340/588

(58) Field of Search ..... 340/521, 522, 340/628, 629, 630, 577, 578, 579, 584, 588, 589

(56) References Cited

U.S. PATENT DOCUMENTS 4,195,286 A 3/1980 Galvin
4,749,986 A * 6/1988 Otani et al. ..... 340/587
4,871,999 A * 10/1989 Ishii et al. ..... 340/587
5,260,687 A * 11/1993 Yamauchi et al. ..... 340/522
5,592,147 A 1/1997 Wong
5,691,703 A * 11/1997 Roby et al. ..... 340/628
5,767,776 A * 6/1998 Wong ..... 340/628
5,818,326 A 10/1998 Winterble et al.
6,154,142 A 11/2000 Kosugi et al.
6,195,011 B1 * 2/2001 Winterble et al. ..... 340/589

FOREIGN PATENT DOCUMENTS

JP 4-270493 9/1992

* cited by examiner

*Primary Examiner*—Daniel J. Wu
(74) *Attorney, Agent, or Firm*—Oblon, Spivak, McClelland, Maier & Neustadt, P.C.

(57) ABSTRACT

An improved fire alarm system capable of reliably detecting the presence of fire caused by different sources. The fire alarm system detects a smoke density (S) as well as a temperature difference (ΔT) within a predetermined time interval, and has primary criteria of (i) whether the smoke density (S) exceeds a smoke threshold [e.g., S>5%/m];

(ii) whether the temperature difference (ΔT) exceeds a temperature difference threshold [e.g., ΔT≧18 C]; and (iii) whether a combination of S and ΔT satisfies an inequality [e.g. 2S+ΔT≧12] which is based upon a decreasing function of ΔT with an increase of S. The detected smoke density and the temperature difference are examined with reference to the primary criteria so as to provide a fire warning signal indicating a possible fire presence when anyone of the above primary criteria is satisfied.

10 Claims, 6 Drawing Sheets

FIRE ALARM SYSTEM

BACKGROUND OF THE INVENTION

1. Field of the Invention

The present invention relates to a fire alarm system, and more particularly to a fire alarm system for determination of a fire presence by analysis of two different physical parameters associated with fire.

2. Description of the Prior Art

Japanese Patent Early Publication No. 4-270493 discloses a fire alarm system which monitors a smoke density and an ambient temperature as different parameters associated with fire, and determines a fire presence by analyzing the two monitored parameters. For this purpose, the system gives an inequity as a threshold which is defined by a function of a product of the smoke density and the ambient temperature, and determines the fire presence when the inequity is satisfied. Although this scheme of the fire determination is satisfactory for some environments, it is found still ineffective for the fire determination in a wide variety of environments having different possible sources of fires. That is, the prior system fails to recognize the fire presence when the fire occurs in a condition where either or both of the two parameters is relatively low. For example, the system cannot reliably recognize the fire caused by a non-flame smoldering accompanied with less amount of an initial temperature increase, and the fire caused by an alcohol burning accompanied with a low smoke density, particularly in a low temperature environment as in a winter.

SUMMARY OF THE INVENTION

The above insufficiency has been reduced in the present invention which provides an improved fire alarm system which is capable of reliably detecting the presence of fire caused by different sources. The fire alarm system in accordance with the present invention includes a smoke detector which detects a smoke density (S) in a target environment, and a temperature detector which detects a temperature (T) of the target space to provide a temperature difference (ΔT) within a predetermined time interval. Included in the system is a threshold means which holds a plurality of primary criteria for determination of the fire presence. The primary criteria are:

(i) whether the smoke density (S) exceeds a first smoke threshold (S1) [e.g. $S \geqq 5\%/m$];

(ii) whether the temperature difference (ΔT) exceeds a first temperature difference threshold (TD1) [e.g. $\Delta T \geqq 18$ C]; and (iii) whether a combination of the smoke density (S) and the temperature difference (ΔT) satisfies an inequality [e.g. $2S+\Delta T \geqq 12$] which is based upon a decreasing function of ΔT with an increase of S.

The system has a controller which checks the detected temperature difference ΔT and the detected smoke density S with reference to the above primary criteria so as to provide a fire warning signal indicating a possible fire presence when anyone of the above primary criteria is satisfied.

Thus, by choosing suitable thresholds for the smoke density (S) and the temperature difference (ΔT) and function of these parameters, it is possible to reliably detect the presence of fire occurring in a wide variety of environments. Particularly, by use of the temperature difference (ΔT) as one criteria and as one variable combined with the smoke density (S) to constitute the function of the inequity, it is readily possible to give a consistent and reliable fire detection even at an early stage for the fire caused by various sources.

The first smoke threshold (S1) may be selected to be greater than the smoke density (S) given by the above function for a low range of the temperature difference (ΔT) below a predetermined low limit (TDLow) which is lower than the first temperature difference threshold (TD1). Likewise, the first temperature difference threshold (TD1) may be selected to be greater than the temperature difference given by the above function for a low range of the smoke density (S) below a predetermined low limit ($S_{LOW}$) which is lower than the first smoke threshold (S1). With the selection of the thresholds (S1, TD1), the system can successfully detect the fire characterized by a strong heat with less smoke density, e.g. the fire type of TF 6 (liquid fire <methylated spirits) as specified in the European Standards EU 54-9, and the smoldering characterized by a negligible heat increase but accompanied with a considerable amount of smoke density, e.g., the fire type TF-2 (smoldering pyrolysis <wood>) and TF-3 (growing smoldering <cotton>).

Preferably, the primary criteria may additionally include whether the temperature exceeds a first temperature threshold (T1) [e.g. $T \geqq 57$ C] for more reliable fire detection of fire characterized by a rapid growth of heat.

The controller is configured to check, at a regular time interval, whether or not anyone of the primary criteria is satisfied, and to have a fire decisive function in order to provide a reliable detection of a true fire presence. That is, upon occurrence of the fire warning signal, the fire decisive function operates to give a decision time period and issues the fire decisive signal indicative of the true fire presence when anyone of the primary criteria is satisfied continuously over the decision time period. Whereby, a reliable decision of fire can be made free from any possible errors due to a transient noise.

The controller is preferably given a weighing function of varying the decision time period according to which one of the primary criteria is relied upon to provide the fire warning signal so as to place a weight on determining the true fire presence, thereby reflecting different behaviors of the fire development due to different fire sources so as to achieve reliable decision of the true fire presence.

Further, in order to make the system more intelligent to learn and reflect the actual environment in which the detectors are mounted, the system is preferably designed to have different operation modes which give the decision time periods different from each other, while the threshold means is configured to hold stringent criteria which are analogous to the primary criteria but have low thresholds (S2, TD2) and function of inequality respectively different from those of the primary criteria. In this preferred version, the controller operates:

a) to check the detected temperature difference ΔT and the detected smoke density S with reference to the stringent criteria, in order to provide a fire index indicating which one of the stringent criteria is satisfied by what number of such event within a past predetermined time duration, and b) to select one of the different operation modes in accordance with the fire index in order to determine the true fire presence based upon the decision time period given to the selected mode.

Thus, the true fire decision can be made based upon different decision time period given to the selected mode reflecting the actual environment.

In detail, the system has a time table which specifies different ways of defining the time decision range in match with the environment so that the controller selects, from the time table, the way of defining the time decision range according to which one of the primary criteria is relied upon to provide the fire warning signal. At least one of the operation modes provided in the system is defined to modify the decision time period in a particular scheme. In this connection, the controller is configured to operate:

1) to check the detected temperature difference ΔT and the detected smoke density S with reference to the stringent criteria, in order to provide a fire index indicating which one of the stringent criteria is satisfied by what number of such events within a past predetermined time range,
2) to select one of the different operation modes in accordance with the fire index,
3) to modify the way of the decision time period selected from the time table in accordance with the particular scheme of the selected operation mode, and
4) to determine the true fire presence based upon thus modified decision time period.

Thus, the true fire presence can be realized in a more sophisticated manner to be well reflective of the actual environment being learned by the system itself.

The particular scheme of modifying the decision time period when one of the primary criteria (i) and (iii) is satisfied, is defined, for example, by a) sampling a plurality of the smoke densities (S) satisfying the one of the primary criteria over an immediately preceding time period;
b) obtaining amounts of thus sampled smoke densities (S) in excess of a smoke density level determined by the corresponding one of the primary criteria (i) and (iii);
c) summing the excess amount of the smoke densities (S); and
d) converting the summed amount into the decision time period.

Further, the threshold means may be designed to vary at least one of the first smoke threshold (S1) and the function of equality depending upon the operation mode selected.

The function of inequality utilized in the present invention may be a linear function expressed by $\alpha \cdot S + \Delta T \geqq \beta$, wherein $\alpha$ and $\beta$ is a constant, for easy numerical processing.

These and still other objects and advantageous features of the present invention will become more apparent from the following description of the preferred embodiment when taken in conjunction with the attached drawings.

BRIEF DESCRIPTION OF THE DRAWIGNS

DETAILED DESCRIPTION OF THE EMBODIMENT

Figure 1:
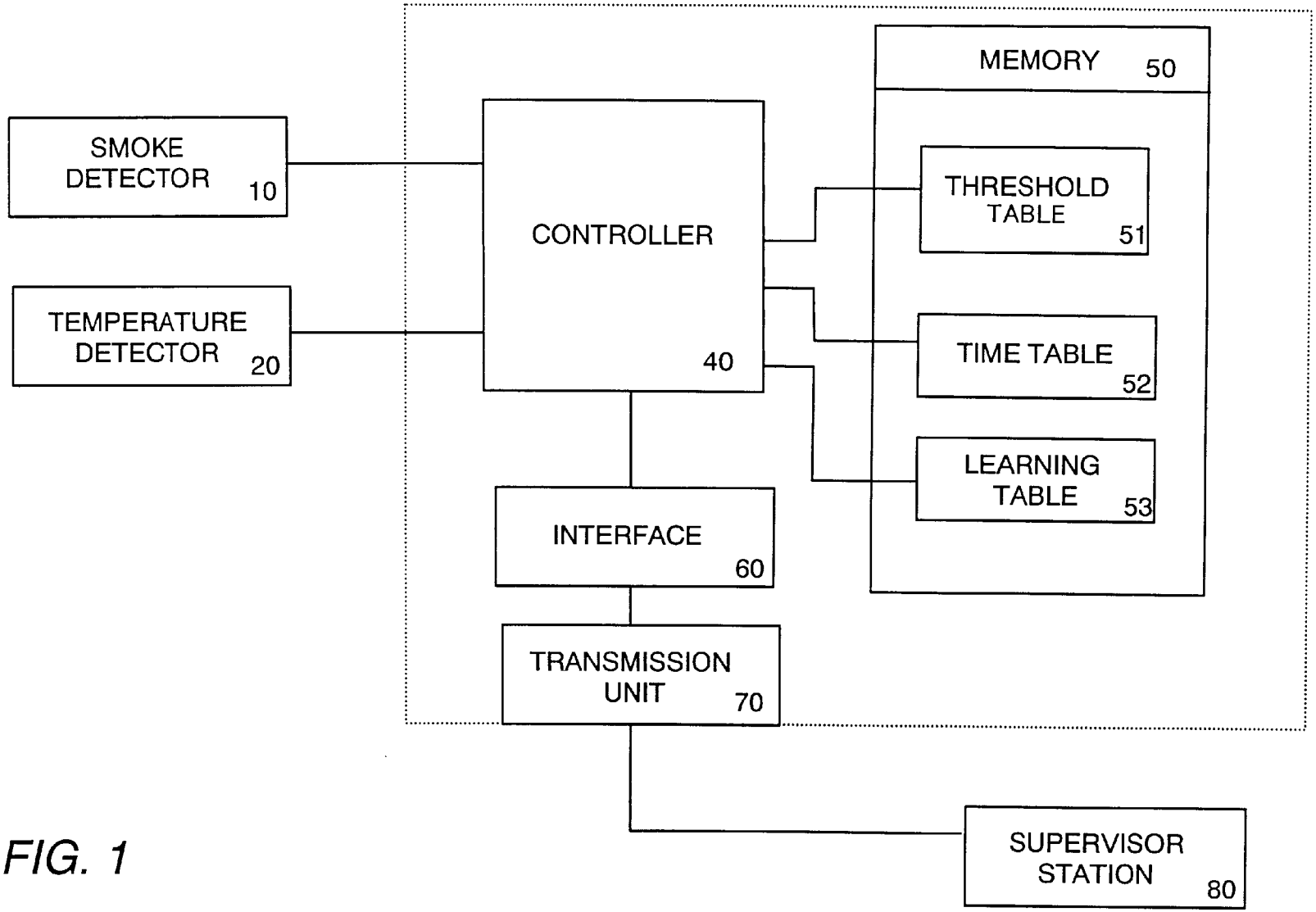
FIG. 1 is a block diagram of a fire alarm system in accordance with a preferred embodiment of the present invention.

A fire alarm system in accordance with the preferred embodiment is discussed in detail with reference to the drawings. As shown in FIG. 1, the system utilizes a composite detector composed of a smoke detector 10 for detecting a smoke density (S) of a target environment and a temperature sensor 20 for detecting a temperature of the environment to provide, at every second, a temperature difference (ΔT) between the current time and 168 seconds before, for example. The smoke detector 10 is of a known light scattering type providing the smoke density (S) in term of an attenuated light factor per unit length (%/m). The detected smoke density (S) and the temperature difference (ΔT) are fed together with the current temperature (T) to a controller 40 where they are analyzed for decision of a true fire presence with reference to primary criteria as well as to various decision time periods given according to specific conditions of various possible environments. When the true fire presence is acknowledged, the controller 40 issues a fire alarm signal indicative of the true fire presence through an interface 60 to a transmission unit 70 which in turn transmits the fire alarm signal to an external supervisor station 80 where it is processed for the purpose of extinguishing the fire. As will be discussed later, the primary criteria are stored in a threshold table 51 together with stringent criteria, while the decision time periods are prescribed in a time table 52. These tables are realized by a memory 50 associated with the microprocessor which constitutes the controller 40, the interface 70 as well as the transmission unit 70. In this sense, all the units except the detectors are realized by a one-chip microcomputer.

Decision of the Fire Presence

Figure 2:
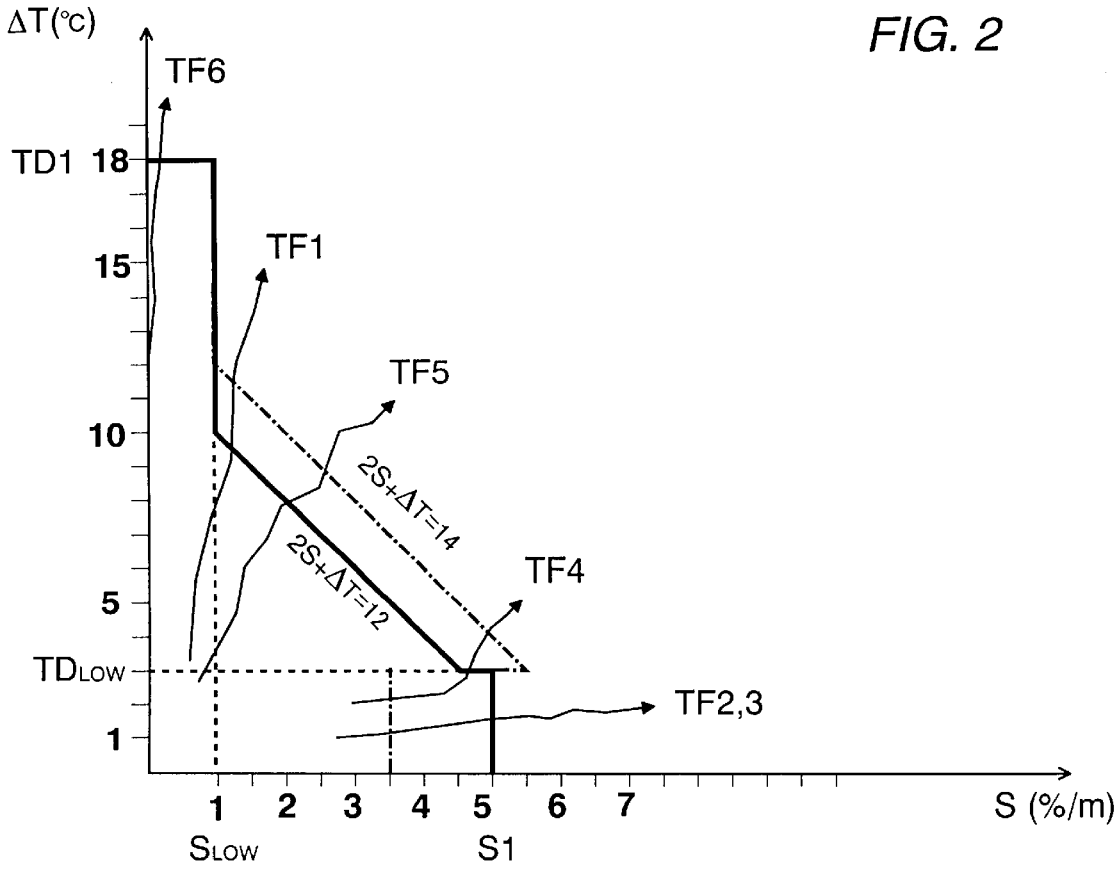
FIG. 2 is a graph illustrating primary criteria utilized in the above system for determination of a fire alarm.

In brief, the system is designed to issue the fire alarm signal indicative of the true fire presence only when a fire warning condition is found with reference to the primary criteria and the fire warning condition continues over the decision time period. As shown in FIG. 2, the primary criteria are (i) whether the smoke density (S) exceeds a first smoke threshold (S1) [e.g. $S \geqq 5\%/m$];
(ii) whether the temperature difference (ΔT) exceeds a first temperature difference threshold (TD1) [e.g. $\Delta T \geqq 18$ C];
(iii) whether a combination of the smoke density (S) and the temperature difference (ΔT) satisfies an inequality [e.g. $2S + \Delta T \geqq 12$] which is based upon a decreasing function of ΔT with an increase of S, and
(iv) whether the current temperature exceeds a first temperature threshold (T1) [e.g. $T \geqq 57$ C].

The decreasing function is referred to sometimes as a first combination threshold.

When anyone of the primary criteria is satisfied, the controller 40 provides the fire warning signal and goes into a verification stage of examining whether or not the fire warning condition continues over the decision time period immediately subsequent to the advent of the fire warning condition. If the fire warning condition continues over the decision time period, the controller 40 issues the fire alarm signal. The decision time period is set to vary according to which one of the primary criteria is satisfied and also according to a particular operation mode which is selected by the system from various predetermined operation modes to be well reflective of the actual environment where the detectors are installed.

Learning & Identifying the Operation Mode

Figure 3:
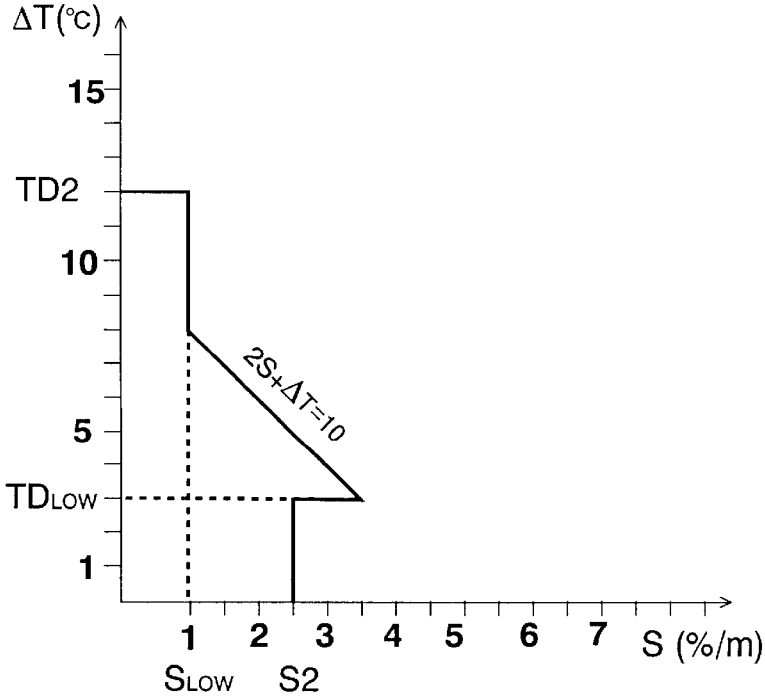
FIG. 3 is a graph illustrating stringent criteria utilized in the above system for selecting one of a default mode, heating mode, cooking mode, cigarette smoking or steaming mode, and a clean room mode prior to determination of the fire alarm.

In order to make the system compatible to the actual environment, the system is programmed to learn which one of the operation modes is consistent with the actual environment for reliable fire detection. For this purpose, the threshold table 51 provides the stringent criteria which, as shown in FIG. 3, are analogous to the primary criteria and have (i) whether the smoke density (S) exceeds a second smoke threshold (S2) [e.g. S≧2.5%/m];

(ii) whether the temperature difference (ΔT) exceeds a second temperature difference threshold (TD2) [e.g. ΔT≧12 C]; and (iii) whether a combination of the smoke density (S) and the temperature difference (ΔT) satisfies an inequality [e.g. 2S+ΔT≧10] which is based upon a decreasing function of ΔT with an increase of S.

The decreasing function is referred to sometimes as a second combination threshold.

Figure 4:
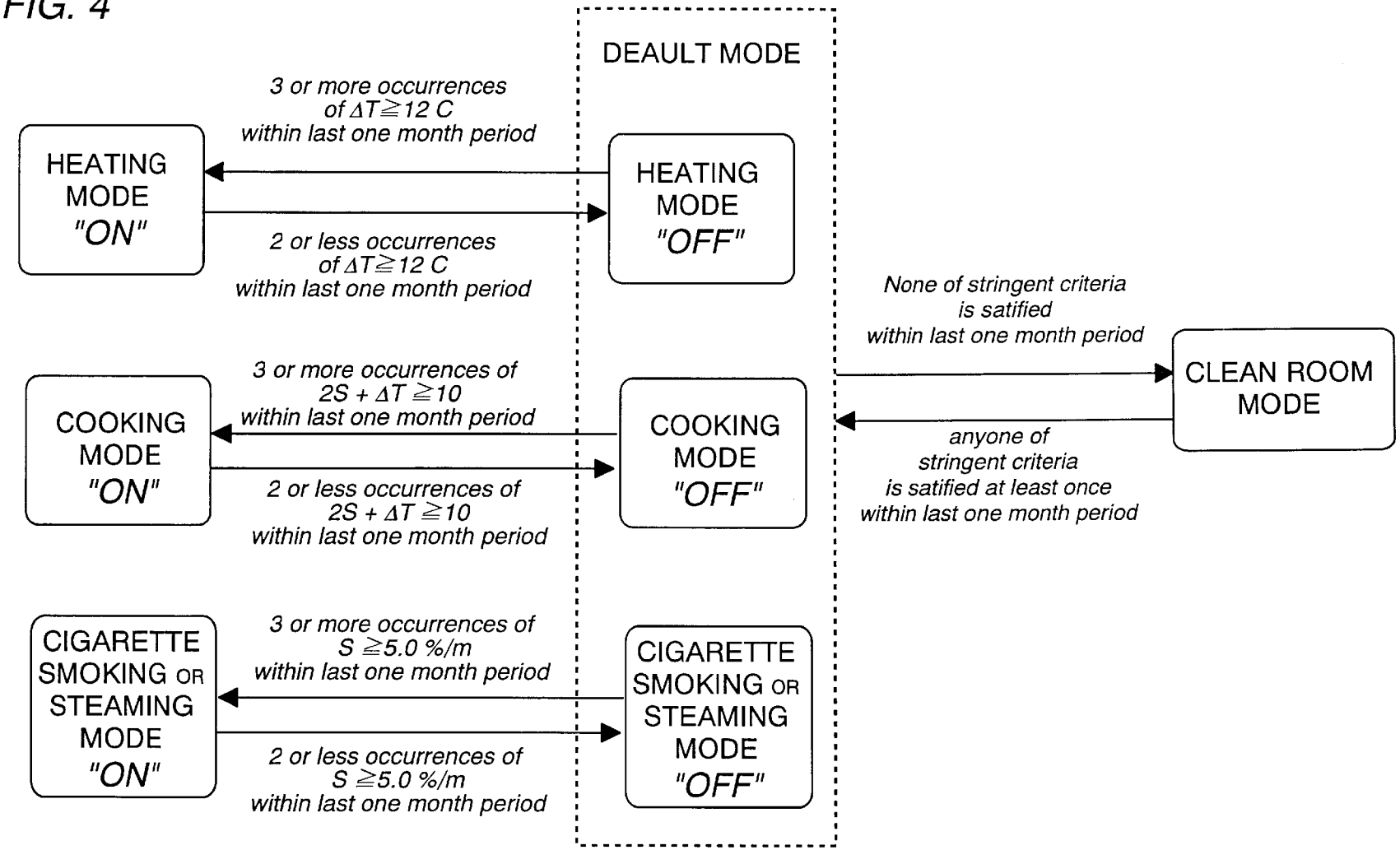
FIG. 4 is a diagraph illustrating the relationship between the above operation modes.

As shown in FIG. 4, the operation modes provided by the system include a default mode, a clean room mode, a heating mode, a cooking mode, and a cigarette smoking or steaming mode. Strictly speaking, one or more of the modes has its own way of defining the decision time period, making it possible to vary the time range different from one mode to another mode. In addition, the mode other than the default mode and the cigarette smoking or steaming mode are set to modify one or more of the primary criteria, as shown in Table 1 below.

TABLE 1

| Primary criteria | Default mode & cigarette smoking or steaming mode | Clean room mode | Heating mode | Cooking mode |
|---|---|---|---|---|
| i) | S ≧ S1 (=5%/m) | S ≧ S1 (=3.5%/m) | Remain unchanged | Remain unchanged |
| ii) | ΔT ≧ TD1 (=18° C.) | Remain unchanged | Not applied | Remain unchanged |
| iii) | 2S + ΔT ≧ 12 | 2S + ΔT ≧ 10 | Remain unchanged | 2S + ΔT ≧ 14 |
| iv) | T ≧ T1 (=57° C.) | Remain unchanged | Remain unchanged | Remain unchanged |

The controller 40 is responsible for selecting one of the modes based upon how many time and which one of the stringent criteria was satisfied within the last one month period. When the second temperature difference threshold (TD2) is exceeded more than two times during the same period, the heating mode is selected for the fire determination. When the second combination threshold is exceeded (2S+ΔT≧10) more than 2 times within the same period, the cooking mode is selected. When the second smoke threshold (S2) is exceeded more than two times within the same period, the cigarette smoking or steaming mode is selected. When none of the stringent criteria is satisfied at least once within the same period, the clean room mode is selected. Otherwise, the default mode is selected.

After learning the actual environment to select the appropriate operation mode, the system proceeds to the fire detection with reference to the primary criteria modified or unmodified by the selected mode and with reference to the decision time period determined according to which one of the primary criteria is relied upon and also specific to the selected mode.

Determination of the Decision Time Period and the Fire Presence

1) When the first temperature difference threshold (TD1) is exceeded (ΔT≧18° C.) or the first temperature threshold (T1) is exceeded (T≧57° C.)) to provide the fire warning signal, the decision time period is fixed to nine (9) seconds. The condition of ΔT≧18° C. is typical for the fire type TF6 (liquid fire <methylated spirits>) as specified in the European Standards EU 54-9 and characterized by the fire signature exemplarily indicated in FIG. 2. If the fire warning condition continues over 9 seconds immediately subsequent to the advent of the fire warning signal, the controller 40 responds to issue the fire alarm signal, indicating the true fire presence.

2) When the first smoke density threshold (S1) is exceeded (S≧S1) to provide the fire warning signal, the decision time period is determined differently according to whether or not the cigarette smoking or steaming mode is selected. The fire warning condition is typical for the fire type TF2 (smoldering pyrolysis <wood>), TF3 (Glowing smoldering <cotton>), and TF4 (open plastic <polyurethane>) characterized by the fire signatures as exemplarity indicated in FIG. 2. It is noted in this connection that the fire type TF4 includes a fire that is not accompanied with critical increase of the smoke density. Such fire, however, can be successfully acknowledge by use of the first combination threshold.

In case the cigarette smoking or steaming mode is not selected, the controller 40 calculates an average (Davg) of the smoke densities detected within immediately preceding 60 seconds and fetches values corresponding to the calculated average from the time table 52 as shown in Table 2 below. If the fire warning condition continues over thus fetched time range subsequent to the first advent of such condition, the controller 40 issues the fire alarm signal.

TABLE 2

| Average smoke density Davg [%/m] | Decision time period (seconds) |
|---|---|
| 0 ≦ Davg < 0.3 | 45 |
| 0.3 ≦ Davg < 0.6 | 39 |
| 0.6 ≦ Davg < 0.8 | 30 |
| 0.8 ≦ Davg < 2.5 | 18 |
| 2.5 ≦ Davg | 9 |

Figure 5:
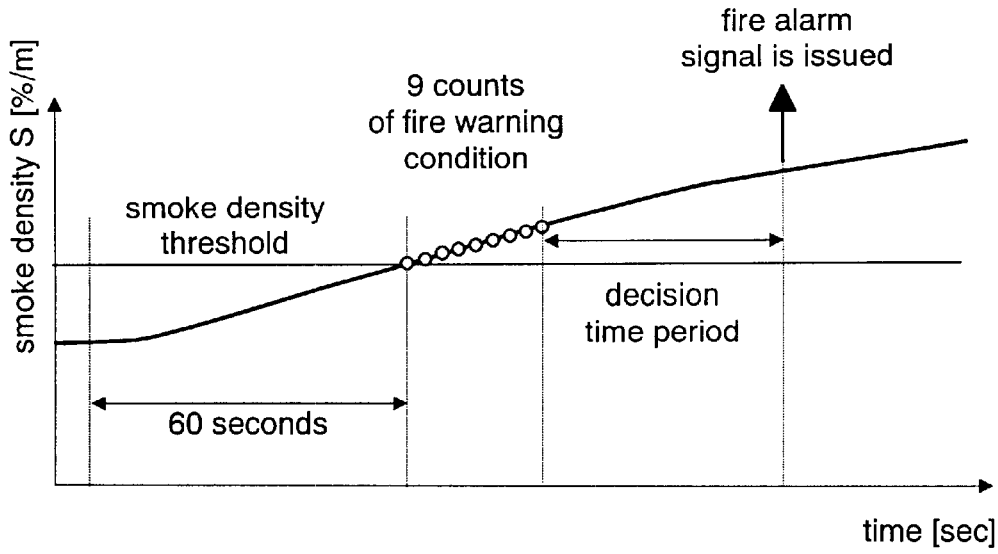
FIG. 5 is a graph illustrating a manner of deciding the true fire presence in the cigarette smoking or steaming mode when the fire warning signal results from a condition where a detected smoke density exceeds a smoke density threshold, one of the above primary criteria.

In case this mode is selected, the controller 40 calculates, in addition to obtaining the like average (Davg) of the smoke densities, an excess amount of the smoke density over the first smoke density threshold (S1) for each of nine (9) consecutive smoke densities detected to exceed the threshold (S1) after the first smoke density threshold (S1) is firstly exceeded. Then, the controller 40 obtains a total value (%/m) of the excess amounts divided by two (2), and converts the total values (%/m) into seconds in accordance with a conversion rate of one unit smoke density (%/m) equivalent to one second. Thus converted value is added to those fetched from the above time table according to the average smoke density (Davg) so as to give the decision time period. Thus determined time range is set to start from the ninth (9th) occurrence of the fire warning condition, as shown in FIG. 5. If the condition of S≧S1 continues over the decision time period, the controller 40 issues the fire alarm signal immediately after the elapse of the decision time period.

3) When the first combination threshold is exceeded (2S+ΔT≧12 in the default mode/cigarette smoking or steaming mode or heating mode; 2S+ΔT≧10 in the clean room mode, 2S+ΔT≧14 in the cooking mode), the decision time period is determined differently according to whether or not the cooking mode is selected. This fire warning condition is typical for the fire type TF1 (open celluose) and TF5 (liquid fire <n-hepthane>) characterized by the fire signature as exemplarity indicated in FIG. 2.

Figure 6:
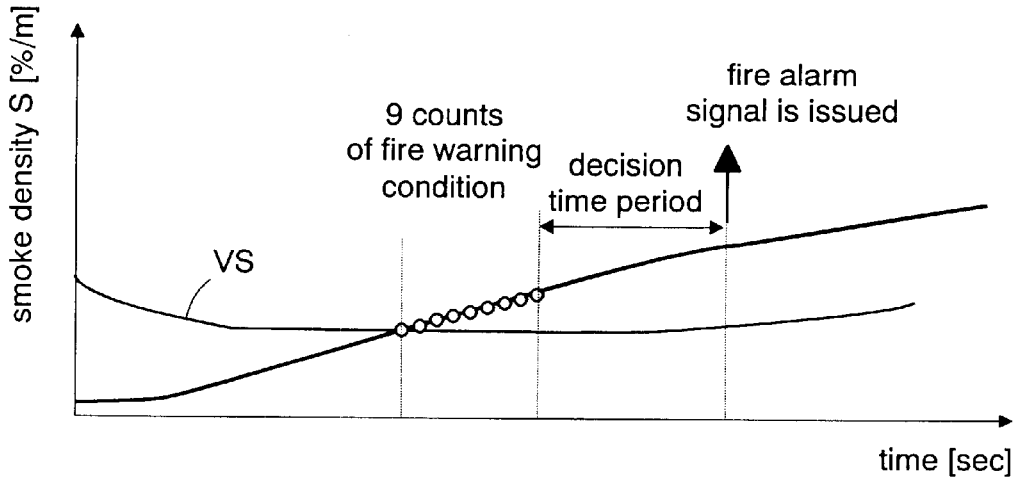
FIG. 6 is a graph illustrating a manner of deciding the true fire presence when the fire warning signal results from a condition where an inequality as another of the primary criteria is satisfied.

In case the cooking mode is not selected, the controller 40 calculates an excess amount of the smoke density over a varying smoke density threshold (VS) which varies with the instant temperature difference (ΔT) along the line of the first combination threshold (e.g. 2S+ΔT=12) for each of nine consecutive events detected to exceed the first combination threshold after the first combination threshold is firstly exceeded. Then, the controller 40 obtains a total values (%/m) of the excess amounts divided by two (2), and converts the total values (%/m) into corresponding seconds in accordance with a conversion rate of one unit smoke density (%/m) equivalent to one second. Thus converted values (seconds) give the decision time period which is set to start from the ninth (9th) occurrence of the fire warning condition, as shown in FIG. 6. If the fire warning condition continues over thus determined decision time period, the controller 40 issues the fire alarm signal immediately after the elapse of the decision time period.

In case the cooking mode is selected, the controller 40 calculates an excess amount of the smoke density over the varying smoke density threshold (VS) for each of nine consecutive events detected to exceed the first combination threshold after the first combination threshold is firstly exceeded. Then, the controller 40 obtains a total value (%/m) of the excess amounts, and converts the total values (%/m) into corresponding seconds in accordance with a conversion rate of one unit smoke density (%/m) equivalent to one second. Thus converted values (seconds) give the decision time period which is set to start from the ninth (9th) occurrence of the fire warning condition in the same manner as in the above case. If the fire warning condition continues over thus determined decision time period, the controller 40 issues the fire alarm signal immediately after the elapse of the decision time period. In this manner, consistent and reliable fire determination can be made in match with the actual environment and the different fire characteristics or sources of fire.

In the above description, the individual values and constants for various thresholds are given for an exemplary purpose, and may be modified according to a specific requirement or regulation.

Figure 7:
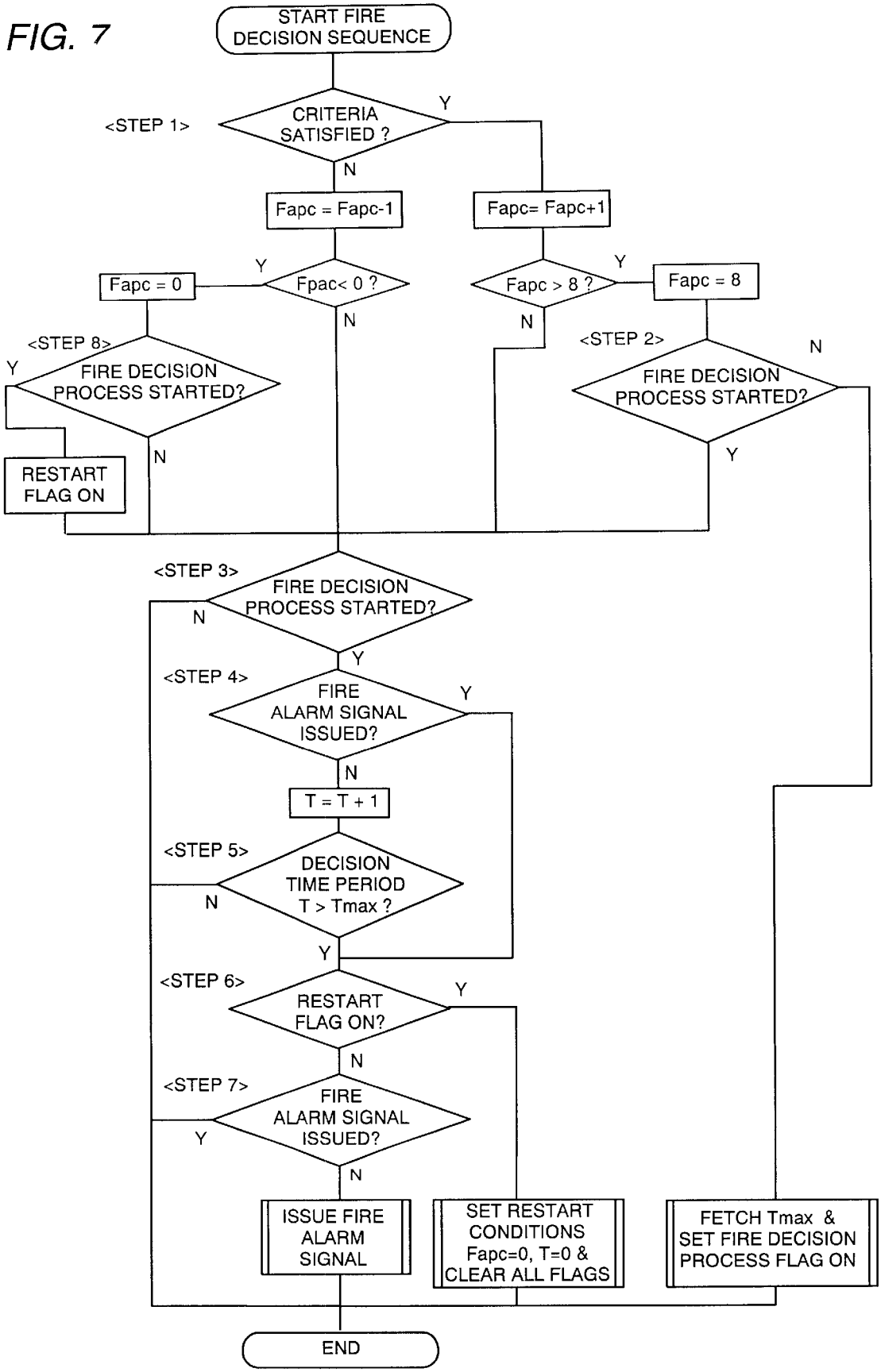
FIG. 7 is a flow chart illustrating a fire decision sequence of the above system.

The above fire decision and the selection of the operation mode are being constantly executed by the controller 40 in accordance with a program stored the memory. FIG. 7 illustrates a flowchart of a fire decision sequence constantly repeated by the program for decision of the true fire presence. The first step (step 1) in the sequence is to check whether or not the detected parameters satisfy any one of the primary criteria. If satisfied, a counter is incremented by 1 to accumulate fire counts (Fapc) of the fire warning condition (Fapc=Fapc+1), while the counter is decremented by 1 (Fapc=Ffapc−1) if not satifiefd. When the fire count exceeds eight (Fapc>8), it is fixed (Fapc=8) and a control is proceed to check whether or not a fire decision process is in progress. When the fire decision process has not been started, i.e., ninth (9th) occurrence of the fire condition is firstly acknowledged at step 2, the controller responds to fetch the decision time period (Tmax) from the memory to be ready for judging the fire presence with reference to the fetched decision time period (Tmax), and at the same time to set on a fire decision process flag indicating that the sequence enter the fire decision process. If the fire warning conditions continues over 9 times, the step 2 is followed through step 3 by step 4 in which it is checked whether the fire alarm signal has been issued. If not, the time count (T) is incremented by 1 (T=T+1) and is subsequently compared with the fetched time decision range (Tmax) to check whether T>Tmax at step 5. When T>Tmax is satisfied after repeating above sequences, i.e., the fire warning condition continues over the fetched decision time period (Tmax), it is checked at step 6 as to whether a restart flag is on and at step 7 as to whether the fire alarm signal has been issued. When neither of conditions at steps 6 and 7 is met, the fire alarm signal is issued.

When the fire warning condition is followed by no such condition for such a time interval that the fire count is decremented to zero (Fapc=0), it is checked at step 8 whether the fire decision process has been started. If found started, a restart flag is set on to indicate the necessity of resetting the fire count (Fapc) to zero, and time count (T) to zero so as to make the system ready for restarting the fire decision sequence. After the restart flag is set on and when the time prescribed by the decision time period (Tmax) has elapsed, step 6 is followed by restarting the sequence by resetting the fire count and time count to zero and clearing the restart flag and the fire decision flag, causing the system to respond to another first occurrence of the fire warning condition.

Figure 8:
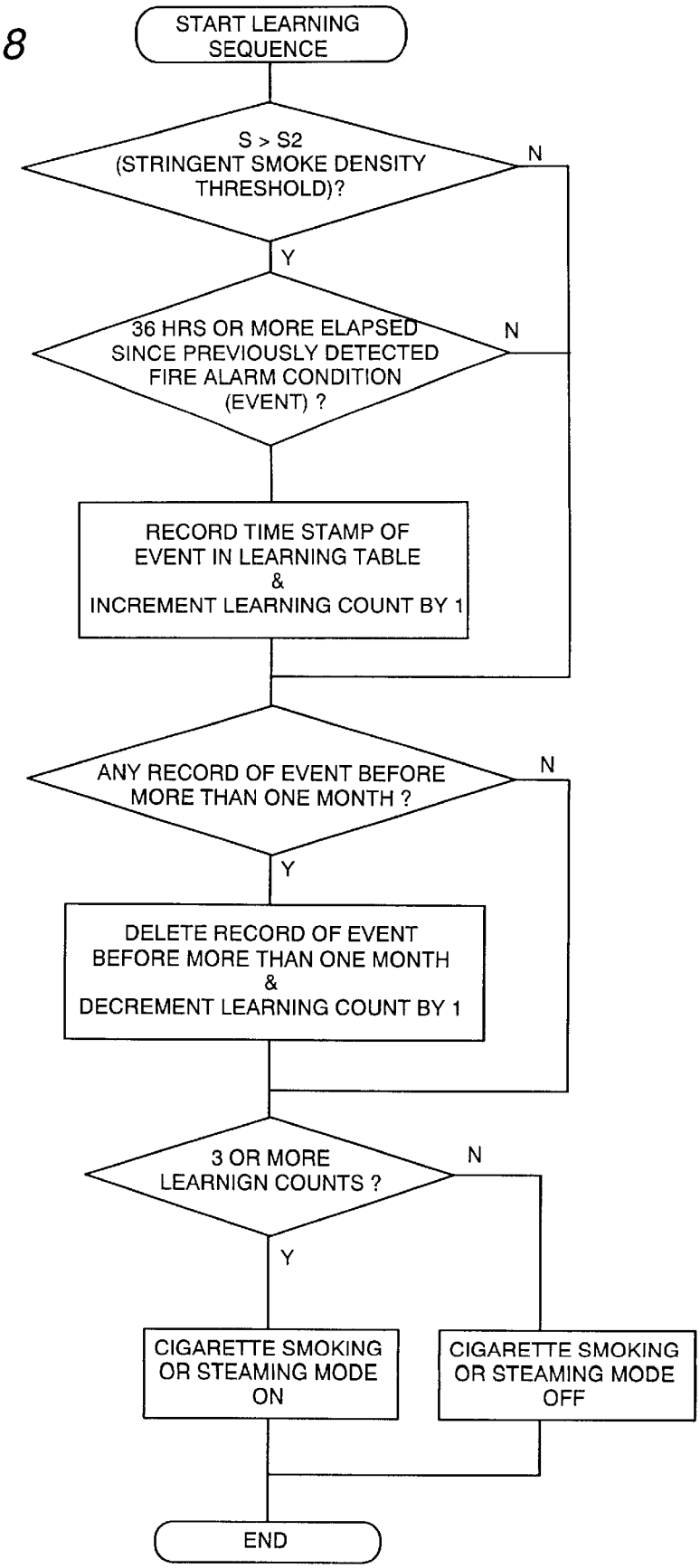
FIG. 8 is a flow chart illustrating a learning sequence of the above system.

FIG. 8 illustrates a learning sequence which is repeated in parallel with the above fire decision sequence to select the one of the various modes, as discussed in the above. The learning sequence is performed at a relatively long interval relative to the fire decision sequence, for example, at every 13 minutes. For easy understanding of the learning capability given to the system, the illustrated learning sequence is for examining whether or not the cigarette smoking or steaming mode is to be selected. Firstly, the current smoke density (S) is compared with the second smoke threshold S2 of the stringent criteria, which is ½ of S1 of the primary criteria. If S>S2, it is checked whether 36 hrs or more have been elapsed since the previous event of S>S2, i.e., the fire warning condition detected in term of the stringent criteria. If satisfied, the time stamp of the instant event is recorded in a learning table 53 of the memory 50 and at the same time a learning count is incremented by one (1). Subsequently, it is checked whether there is any record of such event, i.e., the fire warning condition detected in terms of the stringent criteria, before more than one month. If so, the record of the event occurred before more than one month is deleted and the learning count is decremented by one (1). Finally, it is checked whether the leaning count exceeds three (3), i.e., whether the fire warning condition in terms of the stringent criteria is detected 3 times or more within the last one month period. If there is found 3 or more events within this period, the cigarette smoking or steaming mode is selected by the system. Otherwise, this mode is made off. In the like manner, the examination of the other modes (the heating mode, the cooking mode, and the clean room mode) are made in parallel or in series with the above sequence.

What is claimed is:

1. A fire alarm system comprising:

a smoke detector which detects a smoke density (S) in a target environment;

a temperature detector which detects a temperature (T) of the target environment to give a temperature difference (ΔT) within a predetermined time interval;

threshold means for holding a plurality of primary criteria for determination of a fire presence, said primary criteria comprising:

(i) whether the smoke density (S) exceeds a first smoke threshold (S1);

(ii) whether the temperature difference (ΔT) exceeds a first temperature difference threshold (TD1); and (iii) whether a combination of the smoke density (S) and the temperature difference (ΔT) satisfies an inequality which is based upon a decreasing function of ΔT with an increase of S;

a controller which checks the detected temperature difference ΔT and the detected smoke density S with reference to said primary criteria so as to provide a fire warning signal indicating a possible fire presence when anyone of the above primary criteria is satisfied.

2. The fire alarm system as set forth in claim 1, wherein said first smoke threshold (S1) is greater than the smoke density (S) given by the above function for a low range of the temperature difference (ΔT) below a predetermined low limit ($TD_{Low}$) which is lower than the first temperature difference threshold (TD1), and said first temperature difference threshold (TD1) is greater than the temperature difference given by the above function for a low range of the smoke density (S) below a predetermined low limit ($S_{LOW}$) which is lower than the first smoke threshold (S1).

3. The fire alarm system as set forth in claim 1, wherein said primary criteria further includes whether the temperature exceeds a first temperature threshold (T1).

4. The fire alarm system as set forth in claim 1, wherein said controller operates to check, at a regular short time interval, whether or not anyone of the primary criteria is satisfied, said controller having a fire decisive function which, upon occurrence of said fire warning signal, provides a decision time period and issues a fire decisive signal indicative of a true fire presence when anyone of said primary criteria is satisfied continuously over said decision time period.

5. The fire alarm system as set forth in claim 4, wherein said controller has a weighing function of varying said decision time period according to which one of said primary criteria is relied upon for providing said fire warning signal, in order to place a weight on determining the true fire presence.

6. The fire alarm system as set forth in claim 4, wherein said system has different operation modes which assigns said decision time periods different from each other, said threshold means further holding stringent criteria which are analogous to said primary criteria but have low thresholds (S2, TD2) and function of inequality respectively different from those of said primary criteria, and said controller operating a) to check the detected temperature difference ΔT and the detected smoke density S with reference to said stringent criteria, in order to provide a fire index indicating which one of said stringent criteria is satisfied by what number of such event within a past predetermined time duration, and b) to select one of said different operation modes in accordance with the fire index in order to determine the true fire presence based upon the decision time period assigned to the selected mode.

7. The fire alarm system as set forth in claim 4, wherein said system has a time table which specifies different ways of defining said time decision range, said controller selecting, from said time table, the way of defining the time decision range according to which one of said primary criteria is relied upon to provide said fire warning signal, said system further providing different operation modes at least one of which modifies, in a particular scheme, said decision time period specified by said time table, said threshold means further holding stringent criteria which are analogous to said primary criteria but have low thresholds (S2, TD2) and function of inequality respectively different from those of said primary criteria, said controller operating a) to check the detected temperature difference ΔT and the detected smoke density S with reference to said stringent criteria, in order to provide a fire index indicating which one of said stringent criteria is satisfied by what number of such events within a past predetermined time range, b) to select one of said different operation modes in accordance with the fire index, c) to modify the decision time period specified by said time table in accordance with the particular scheme of the selected operation mode, and d) to determine the true fire presence based upon thus modified decision time period.

8. The fire alarm system as set forth in claim 7, wherein said particular scheme of modifying the decision time period when one of the above primary criteria (i) and (iii) is satisfied, is defined by a) sampling a plurality of the smoke densities (S) satisfying the one of the primary criteria over an immediately preceding time period;

b) obtaining amounts of thus sampled smoke densities (S) in excess of a smoke density level determined by the corresponding one of the primary criteria (i) and (iii);

c) summing the excess amount of the smoke densities (S); and d) converting the summed amount into said decision time period.

9. The fire alarm system as set forth in claim 6, wherein said threshold means varies at least one of the first smoke threshold (S1) and the function of equality depending upon the operation mode selected.

10. The fire alarm system as set forth in claim 1, wherein said function of inequality is a linear function expressed by $\alpha \cdot S + \Delta T \geqq \beta$, wherein α and β is a constant.

* * * * *